US006127325A

United States Patent [19]

Suyama et al.

[11] Patent Number: 6,127,325

[45] Date of Patent: Oct. 3, 2000

[54] VISCOSITY INDEX IMPROVER, PROCESS FOR PREPARING THE SAME AND LUBRICATING OIL COMPOSITION

[75] Inventors: Shuji Suyama, Aichi-ken; Yoshiki Higuchi, Handa; Hidefumi Tochigi; Hiroshi Ohmura, both of Aichi-ken, all of Japan

[73] Assignee: NOF Corporation, Japan

[21] Appl. No.: 09/068,282

[22] PCT Filed: Nov. 7, 1996

[86] PCT No.: PCT/JP96/03251

§ 371 Date: Oct. 5, 1998

§ 102(e) Date: Oct. 5, 1998

[87] PCT Pub. No.: WO97/17417

PCT Pub. Date: May 15, 1997

[30] Foreign Application Priority Data

Nov. 7, 1995 [JP] Japan ..... 7-288896

[51] Int. Cl.[7] ..... C10M 145/22; C10M 145/24; C10M 145/18; C08L 33/14; C08L 29/00

[52] U.S. Cl. ..... 508/465; 508/221; 508/242; 508/452; 508/454; 508/468; 508/470; 508/472; 525/223; 525/231

[58] Field of Search ..... 525/223, 231; 508/452, 454, 465, 468, 470, 472, 221, 242

[56] References Cited

FOREIGN PATENT DOCUMENTS

| | | |
|---|---|---|
| 53-39305 | 9/1976 | Japan . |
| 58-65246 | 4/1983 | Japan . |
| 5-86114 | 4/1993 | Japan . |

*Primary Examiner*—Jerry D. Johnson
*Attorney, Agent, or Firm*—Vidas, Arrett & Steinkraus, P.A.

[57] ABSTRACT

A viscosity index improver for addition to lubricating oil or the like, which comprises a graft copolymer having structural units of an oil-soluble polymer (a) comprising an olefin polymer and structural units of a copolymer (b) of a monomer having a peroxide bond with a (meth)acrylate or the like or a copolymer (c) of a monomer having a peroxide bond with 2-hydroxyethyl(meth)acrylate or the like. The improver is excellent in the effect of improving the viscosity index, the thickening effect, the fluidity at low temperatures and the shear stability, and has no fear of causing phase separation in lubricating oil.

16 Claims, No Drawings

VISCOSITY INDEX IMPROVER, PROCESS FOR PREPARING THE SAME AND LUBRICATING OIL COMPOSITION

TECHNICAL FIELD

The present invention relates to a viscosity index improver to be added to lubricating oils such as engine oils, gear oils, transmission oils and hydraulic oils, a process for producing the same and a lubricating oil composition. More particularly, the present invention relates to a viscosity index improver which has excellent viscosity index improving property, thickening property, low-temperature fluidity and shear stability and which does not undergo separation in a lubricating oil, to a process for producing the same and to a lubricating oil composition prepared by incorporating the viscosity index improver into a lubricating oil.

BACKGROUND ART

It is practically preferred that lubricating oils employable as engine oils, hydraulic oils, etc. undergo least viscosity change over a wide temperature range from low temperatures to high temperatures. Viscosity index is employed as a measure of this property, and the greater the viscosity index is, the higher is the stability to temperature changes. It is known that viscosity index of an oil can be improved by adding to it a certain kind of polymer. As such polymers, for example, polymethacrylates (PMA) (Japanese Unexamined Patent Publication No. Hei 7-62372), olefin copolymers (OCP) (Japanese Patent Publication No. Sho 46-34508), hydrogenated styrene/diene copolymers (SDC) (Japanese Patent Publication No. Sho 48-39203) and polyisobutylenes (PIB) are employed. SDCs assuming polymeric forms of block copolymer (Japanese Unexamined Patent Publication No. Sho 49-47041) and star-shaped polymer (Japanese Unexamined Patent Publication No. Sho 52-96695) have been developed in addition to SDCs assuming a form of random copolymer.

Lubricating oils incorporated with these polymers exhibit characteristics of their own. More specifically, although PMAs have excellent viscosity index improving properties and also have pour point-lowering actions, they have poor thickening effects. In order to improve the thickening effects, the molecular weight of PMAs may be increased. However, PMAs having increased molecular weights come to have extremely low stability to shear forces to be caused by stirring etc. of lubricating oils. PIBs have high thickening effects but poor viscosity index improving properties. OCPs and SDCs have high thickening effects and have low viscosity at low temperatures, but their viscosity index improving properties are inferior to those of PMAs. Meanwhile, those PMAs which are copolymerized with polar monomers can impart to lubricating oils detergent dispersing performance of dispersing sludge in the lubricating oils easily compared with other improvers (Japanese Patent Publication No. Sho 51-20273 and Japanese Unexamined Patent Publication No. Hei 5-222389).

While multi-grade oils having excellent viscosity index improving performances are now generally used as lubricating oils, viscosity index improvers having higher performance are now in demand so as to comply with recent requirements including reduction of energy consumption. It can be contemplated to use a mixture of PMA and OCP or SDC as a composition which satisfies such requirements. However, these compounds have poor compatibility with each other, so that if a mere mixture of such compounds is added to a lubricating oil, the lubricating oil separates into two phases. Therefore, in order to avoid such separation, there are proposed graft copolymers consisting of two different kinds of polymers (Japanese Patent Publication Nos. Sho 59-40194, Sho 62-16997 and Hei 4-50328; Japanese Unexamined Patent Publication No. Hei 6-346078, etc.).

However, the processes for producing such graft copolymers each employ a conventional radical polymerization initiator to carry out graft copolymerization of a methacrylate monomer in the presence of an oil-soluble olefin copolymer. The graft copolymerization in this case takes place based on olefin copolymer chain radicals to be formed when the radical polymerization initiator extracts hydrogen atoms from the olefin copolymer. However, a homopolymer of the methacrylate monomer is also formed in a large amount when the graft copolymerization is carried out to bring about a low graft efficiency.

Accordingly, such graft copolymers involve a problem in that they have poor properties as viscosity index improvers including thickening effect, viscosity behavior, etc. Further, in those graft copolymers having extremely low graft efficiency values, lubricating oil compositions incorporated with them undergo separation. Accordingly, in order to comply with all conceivable severer requirements for lubricants in the future, development of high-performance viscosity index improvers is in demand.

The present invention was accomplished in view of such problems inherent in the prior art, and it is an objective of the invention to provide a viscosity index improver which has excellent viscosity index improving property, excellent thickening effect, excellent low-temperature fluidity and excellent shear stability and which is free from the fear of separation in a lubricating oil, as well as, a process for producing the same and a lubricating oil composition containing the same.

DISCLOSURE OF THE INVENTION

The viscosity index improver according to the present invention contains a graft copolymer which has a structural unit formed by an oil-soluble polymer (a) containing an olefin polymer and a structural unit formed by a peroxy bond-containing polymer (b) or a polymer (c) containing a peroxy bond and a predetermined functional group.

The oil-soluble polymer (a), the polymers (b) and (c) are preferably as follows:

(a) one or more oil-soluble polymers selected from the group consisting of ethylene/α-olefin copolymers, styrene/hydrogenated diene copolymers, hydrogenated polybutadienes, hydrogenated polyisoprenes, polybutenes, ethylene/(meth)acrylic acid ester copolymers and ethylene/vinyl ester copolymers;

(b) a copolymer to be obtained by copolymerizing a peroxy bond-containing monomer with one or more monomers selected from the group consisting of (meth) acrylic acid esters, unsaturated dicarboxylic acid esters, vinyl esters of fatty acids having 2 to 18 carbon atoms and aromatic monomers having 8 to 12 carbon atoms; and (c) a copolymer to be obtained by copolymerizing a peroxy bond-containing monomer with one or more monomers selected from the group consisting of (meth) acrylic acid esters, unsaturated dicarboxylic acid esters, vinyl esters of fatty acids having 2 to 18 carbon atoms and aromatic monomers having 8 to 12 carbon atoms and with one or more monomers selected from the group consisting of tertiary nitrogen-containing monomers and monomers containing either or both of a hydroxyl group and an ether bond.

It should be noted here that in the present invention, acrylate and methacrylate are generally referred to as (meth) acrylate; while allyl and methallyl are generally referred to as (meth)allyl.

Further, the viscosity index improver according to the present invention contains the following graft copolymer (i) and either or both of the following copolymer (ii) and the following copolymer (iii):

(i) a graft copolymer formed by the oil-soluble polymer (a) and the peroxy bond-containing copolymer (b) or (c);

(ii) the oil-soluble polymer (a); and (iii) a copolymer to be derived from the copolymer (b) or (c).

Incidentally, the copolymer to be derived from the copolymer (b) or (c) means a copolymer which is not grafted to or with the oil-soluble polymer (a).

Meanwhile, the process for producing a viscosity index improver according to the present invention comprises heating a mixture of the oil-soluble polymer (a) and a peroxy bond-containing copolymer (b) or (c) to such a temperature that the peroxy bond cleaves to effect grafting.

Further, the process for producing a viscosity index improver according to the present invention comprises adding to a lubricant base oil the following monomer mixture (d) or (e) and a radical polymerization initiator to effect copolymerization of the monomer mixture at such a temperature that the radical polymerization initiator decomposes and that the peroxy bond of the peroxy bond-containing monomer does not substantially cleave, and adding the oil-soluble polymer (a) to the resulting mixture to be dissolved therein, followed by heating of the mixture to such a temperature that peroxy bonds derived from the peroxy bond-containing monomer cleave to effect grafting:

(d) a monomer mixture containing a peroxy bond-containing monomer and one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms; or (e) a monomer mixture containing a peroxy bond-containing monomer, one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms and one or more monomers selected from the group consisting of tertiary nitrogen-containing monomers and monomers containing either or both of a hydroxyl group and an ether bond.

Further, the process for producing a viscosity index improver comprises adding to a lubricant base oil the oil-soluble monomer (a), the monomer mixture (d) or (e) and a radical polymerization initiator to effect copolymerization of the monomer mixture at such a temperature that the radical polymerization initiator decomposes and that the peroxy bond of the peroxy bond-containing monomer does not substantially cleave, followed by heating of the resulting mixture to such a temperature that peroxy bonds derived from the peroxy bond-containing monomer cleave to effect grafting.

Further, the process for producing a viscosity index improver comprises a first step of adding to an aqueous suspension of particles of the oil-soluble polymer (a) the monomer mixture (d) or (e) and a radical polymerization initiator, and heating the resulting mixture at such a temperature that the radical polymerization initiator does not substantially decompose to impregnate the particulate oil-soluble polymer (a) with the monomer mixture and the radical polymerization initiator, followed by heating of the resulting aqueous suspension at such a temperature that the radical polymerization initiator decomposes and that the peroxy bond of the peroxy bond-containing monomer does not substantially cleave to effect copolymerization of the monomer mixture in the particulate oil-soluble polymer (a) and obtain a graft precursor; and a second step of melt-kneading the graft precursor at such a temperature that peroxy bonds derived from the peroxy bond-containing monomer cleave to effect grafting.

In addition, the lubricating oil composition according to the present invention is prepared by adding to a lubricating oil the viscosity index improver described above.

Embodiments of the present invention will be described below in detail.

First, the viscosity index improver according to the present invention will be described.

The viscosity index improver contains a graft copolymer in which a structural unit formed by an oil-soluble polymer (a) containing an olefin polymer is grafted to or with a structural unit formed by a peroxy bond-containing polymer (b) or a polymer (c) containing a peroxy bond and a certain functional group. The oil-soluble polymer (a) has thickening performance, while the polymer (b) or (c) has pour point lowering performance and viscosity index improving performance. The graft copolymer containing the structural unit formed by the polymer (a) and the structural unit formed by the polymer (b) or (c) exhibit performances of the respective polymers synergistically and also has shear stability.

Incidentally, viscosity index can be calculated, for example, in accordance with JIS K-2283, and the greater the value is, the smaller is the temperature-dependent viscosity change and the more preferred.

In the graft copolymer, the structural unit formed by the oil-soluble polymer (a) constitutes a backbone chain, and the structural unit formed by the polymer (b) or (c) constitutes side chains or vice versa.

Shear stability is supposed to be improved because the viscosity index improver is a graft copolymer and if the side chains of the graft copolymer are severed, the backbone chain remains intact to hardly undergo viscosity reduction. Further, since the viscosity index improver is formed by the structural unit formed by an oil-soluble polymer (a) containing an olefin polymer and the structural unit formed by the polymer (b) or (c) containing, for example, a poly(meth) acrylate polymer having poor compatibility which are chemically bound to each other in the form of graft copolymer, it also has a characteristic that it does not cause phase separation in a lubricating oil.

It is an essential characteristic feature of the viscosity index improver that it contains a peroxy bond-containing polymer. That is, polymer radicals to be formed by cleavage of the peroxy bond by heating, electron transfer or other methods are considered to be bound with the oil-soluble polymer with high efficiency to form a graft copolymer, and thus the graft copolymer can exhibit excellent performance as a viscosity index improver. This is the point which is quite different from the technique in which a graft copolymer of an olefin polymer and a poly(meth)acrylate polymer to be prepared by using a conventional radical polymerization initiator is employed as a viscosity index improver.

The oil-soluble polymer (a) contains one or more polymers selected from the group consisting of ethylene/α-olefin copolymers, styrene/hydrogenated diene copolymers, hydrogenated polybutadienes, hydrogenated polyisoprenes, polybutenes, ethylene/(meth)acrylic acid ester copolymers and ethylene/vinyl ester copolymers. These polymers are substantially oil-soluble and preferably each have a weight average molecular weight of 5000 to 1000000. If the weight average molecular weight is smaller than 5000, the resulting viscosity index improver shows a low thickening effect, whereas if it is greater than 1000000, the resulting viscosity index improver shows low shear stability. Further, the polymer (a) desirably shows oil solubility particularly in lubricating oils.

The α-olefin moieties of the ethylene/α-olefin copolymers preferably include those having 3 to 20 carbon atoms per monomer molecule, since they are readily available. Particularly, propylene and 1-butene are most preferred, since they are inexpensive and are easily available. While the content of ethylene in the graft copolymer may not particularly be limited, it is preferably 20 to 80% by weight in view of low-temperature fluidity.

The styrene/hydrogenated diene copolymers are copolymers of styrene with diene compounds such as butadiene and isoprene, in which the unsaturated bond in the diene moiety of each polymer is substantially hydrogenated. Typically, they include random copolymers, block copolymers, star-shaped copolymers, etc. While the styrene content in the copolymer may not particularly be limited, it is preferably 70% by weight or less, since if it is added in an excessive amount, solubility of the resulting copolymer in a lubricating oil is lowered.

The block copolymers can be exemplified by those described in Japanese Unexamined Patent Publication No. Sho 49-47401 and Hei 1-149899 in which polystyrene segments (S) and hydrogenated polydiene segments (D) are bound to each other alternately and include, for example, S-D di-block copolymers, S-D-S and D-S-D tri-block copolymers. Meanwhile, the star-shaped copolymers can be exemplified by those having a hydrogenated polymer chain of diene or a styrene polymer chain on the benzene nucleus as described in Japanese Unexamined Patent Publication No. Sho 52-96695 and Hei 7-268047. The polybutenes include, for example, poly(1-butene) and polyisobutylene.

The ethylene/(meth)acrylic acid ester copolymers are random copolymers of ethylene and (meth)acrylic acid esters as described, for example, in Japanese Unexamined Patent Publication No. Hei 7-268373. The (meth)acrylic acid esters preferably include $C_1$–$C_{22}$ alkyl(meth)acrylates and typically, for example, methyl(meth)acrylate, ethyl (meth)acrylate, butyl(meth)acrylate, lauryl(meth)acrylate and stearyl(meth)acrylate. The ethylene/vinyl ester copolymers are random copolymers of ethylene and vinyl esters as described, for example, in Japanese Unexamined Patent Publication No. Sho 64-48892, and they may further be copolymerized with third monomers. The vinyl esters preferably include those of fatty acids having 2 to 18 carbon atoms and typically vinyl acetate, vinyl propionate, etc.

Ethylene/α-olefin copolymers or styrene/hydrogenated diene copolymers are preferred among other oil-soluble polymers (a) because of their excellent thickening performance.

Next, the peroxy bond-containing copolymer (b) is a copolymer to be formed by copolymerizing a peroxy bond-containing monomer (component α) with one or more monomers (component β) selected from the group consisting of (meth)acrylic acid esters, unsaturated dicarboxylic acid esters, vinyl esters of fatty acids having 2 to 18 carbon atoms and aromatic monomers having 8 to 12 carbon atoms.

Referring to the amount of each component in this peroxy bond-containing copolymer (b), the component a and the component β are preferably 0.05 to 50% by weight and 50 to 99.95% by weight respectively. If the component a is more than 50% by weight, the resulting viscosity index improver comes to have an extremely great molecular weight to exhibit poor shear stability, and there is a liability of forming a gel content which is insoluble in lubricating oils. Meanwhile, if the component α is less than 0.05% by weight, a low graft efficiency is brought about to be liable to cause separation of lubricating oils into two phases.

The peroxy bond-containing copolymer (c) is a copolymer to be obtained by copolymerizing a monomer constituting the peroxy bond-containing copolymer (b) with one or more monomers (component γ) selected from the group consisting of tertiary nitrogen-containing monomers and monomers containing either or both of a hydroxyl group and an ether bond.

Referring to the amount of each component in this peroxy bond-containing copolymer (c), the component α and the component β are preferably 0.05 to 50% by weight and 50 to 99.95% by weight respectively, based on the same reasons as in the case of the peroxy bond-containing copolymer (b). The amount of component γ is preferably 20% by weight or less, since the performance as the viscosity index improver is deteriorated if it is used in an excessive amount, and the resulting improver becomes insoluble in lubricating oils.

The peroxy bond of the peroxy bond-containing copolymer (b) or (c) is usually on the side chain. (Meth)acrylic acid esters are preferred among others as the component β because of their excellent performance as viscosity index improvers, particularly their low-temperature fluidity. The copolymers (b) and (c) may further be copolymerized with other monomers copolymerizable with them.

If the weight average molecular weight of the peroxy bond-containing copolymer (b) or (c) is too great, the resulting viscosity index improver comes to have poor shear stability; whereas it if it is too small, the improver exhibits poor thickening effect. Accordingly, the weight average molecular weight is preferably 5000 to 1000000, more preferably 10000 to 500000.

As the peroxy bond-containing monomer, any of known peroxy bond-containing monomers can be employed, and preferably monomers represented by the following general formulae (1) to (3) can be employed. These monomers may be used singly or in the form of mixture of two or more of them.

General formula (1)

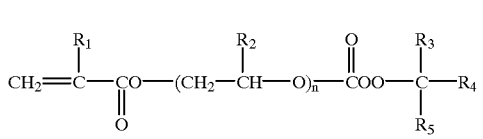

(1)

wherein $R_1$ represents a hydrogen atom or a methyl group; $R_2$ represents a hydrogen atom or a methyl group; $R_3$ and $R_4$ each represent an alkyl group having 1 to 4 carbon atoms; $R_5$ represents an alkyl group having 1 to 12 carbon atoms, a cycloalkyl group having 3 to 12 carbon atoms, a phenyl group or an alkyl-substituted phenyl group; and n is 1 to 5;

General formula (2)

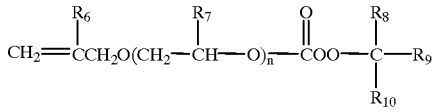

(2)

wherein $R_6$ represents a hydrogen atom or a methyl group; $R_7$ represents a hydrogen atom or a methyl group; $R_8$ and $R_9$ each represent an alkyl group having 1 to 4 carbon atoms; $R_{10}$ represents an alkyl group having 1 to 12 carbon atoms, a cycloalkyl group having 3 to 12 carbon atoms, a phenyl group or an alkyl-substituted phenyl group; and n is 0 to 4;

General formula (3)

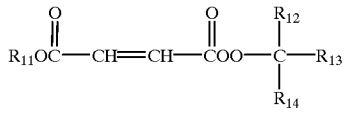

(3)

wherein $R_{11}$ represents a hydrogen atom or a methyl group; and $R_{12}$ and $R_{13}$ each represent an alkyl group having 1 to 4 carbon atoms; $R_{14}$ represents an alkyl group having 1 to 12 carbon atoms, a cycloalkyl group having 3 to 12 carbon atoms, a phenyl group or an alkyl-substituted phenyl group.

Peroxy bond-containing monomers represented by the general formula (1) include typically t-butyl peroxy(meth) acryloyloxyethylcarbonate, t-butyl peroxy(meth) acryloyloxyethoxyethylcarbonate, t-butyl peroxy(meth) acryloyloxyisopropylcarbonate, t-amyl peroxy(meth) acryloyloxyethylcarbonate, t-amyl peroxy(meth) acryloyloxyisopropylcarbonate, t-hexyl peroxy(meth) acryloyloxyethylcarbonate, t-hexyl peroxy(meth) acryloyloxyisopropylcarbonate, t-octyl peroxy(meth) acryloyloxyethylcarbonate, cumyl peroxy(meth) acryloyloxyethylcarbonate, p-isopropylcumyl peroxy(meth) acryloyloxyethylcarbonate, p-menthyl peroxy(meth) acryloyloxyethylcarbonate, 1-cyclohexyl-1-methylethyl peroxy(meth)acryloyloxyethylcarbonate, etc.

Peroxy bond-containing monomers represented by the general formula (2) include typically t-butyl peroxy(meth) allylcarbonate, t-butyl peroxy(meth)allyloxyethylcarbonate, t-butyl peroxy(meth)allyloxyethoxyethylcarbonate, t-amyl peroxy(meth)allylcarbonate, t-hexyl peroxy(meth) allylcarbonate, t-octyl peroxy(meth)allylcarbonate, cumyl (meth)allyl carbonate, etc.

Peroxy bond-containing monomers represented by the general formula (3) include typically t-butyl peroxymethylfumarate, t-butyl peroxyethylfumarate, t-butyl peroxy-n-propylfumarate, t-butyl peroxyisopropylfumarate, t-butyl peroxy-n-buthylfumarate, t-butyl peroxy-t-butylfumarate, t-butyl peroxy-n-octylfumarate, t-butyl peroxy-2-ethylhexylfumarate, t-butyl peroxyphenylfumarate, t-butyl peroxy-m-toluylfumarate, t-butyl peroxycyclohexylfumarate, t-amyl peroxy-n-propylfumarate, t-amyl peroxyisopropylfumarate, t-amyl peroxy-n-butylfumarate, t-amyl peroxyphenylfumarate, t-hexyl peroxyethylfumarate, t-hexyl peroxyisoproylfumarate, t-hexyl peroxy-t-butylfumarate, t-hexyl peroxy-2-ethylhexylfumarate, t-octyl peroxymethylfumarate, t-octyl peroxyisopropylfumarate, t-octyl peroxy-n-octylfumarate, t-octyl peroxycyclohexylfumarate, cumyl peroxyisopropylfumarate, p-menthyl peroxyisopropylfumarate, etc.

Of these peroxy bond-containing monomers, preferred monomers are t-butyl peroxyacryloyloxyethylcarbonate, t-butyl peroxymethacryloyloxyethylcarbonate, t-butyl peroxyallylcarbonate, t-butyl peroxymethallylcarbonate and t-butyl peroxyisopropylfumarate. These peroxy bond-containing monomers have heat decomposition temperatures of 80° C. or higher and are easily available and economical.

Next, the (meth)acrylic acid esters are preferably those having $C_1$–$C_{22}$ alkyl moieties and include, for example, methyl(meth)acrylate, ethyl(meth)acrylate, n-propyl(meth) acrylate, isopropyl(meth)acrylate, n-butyl(meth)acrylate, isobutyl(meth)acrylate, t-butyl(meth)acrylate, hexyl(meth) acrylate, cyclohexyl(meth)acrylate, heptyl(meth)acrylate, octyl(meth)acrylate, 2-ethylhexyl(meth)acrylate, decyl (meth)acrylate, isodecyl(meth)acrylate, lauryl(meth) acrylate, tridecyl(meth)acrylate, myristyl(meth)acrylate, pentadecyl(meth)acrylate, cetyl(meth)acrylate, stearyl (meth)acrylate, eicosyl(meth)acrylate and behenyl(meth) acrylate.

While these (meth)acrylic acid esters may be used singly, a mixture of 1 to 40% by weight of (meth)acrylates having $C_1$–$C_6$ alkyl groups, 30 to 90% by weight of (meth)acrylates having $C_7$–$C_{15}$ alkyl groups and 1 to 40% by weight of (meth)acrylates having $C_{16}$–$C_{22}$ alkyl groups is preferably used. The reason is that use of the thus combined mixture can improve low-temperature fluidity and viscosity index of the viscosity index improver and also solubility thereof in lubricating oils.

The unsaturated dicarboxylic acid esters are preferably those having $C_1$–$C_{22}$ alkyl groups. Such esters include, for example, dimethyl maleate, dibutyl maleate, dihexyl fumarate, dioctadecyl fumarate and dilauryl itaconate.

The vinyl esters of fatty acids having 2 to 18 carbon atoms include, for example, vinyl acetate, vinyl propionate, vinyl 2-ethylhexanoate, vinyl decanoate and vinyl dodecanoate.

The aromatic monomers having 8 to 12 carbon atoms include, for example, styrene, α-methylstyrene, α-ethylstyrene, vinyltoluene, dimethylstyrene, t-butylstyrene, chlorostyrene and bromostyrene.

The tertiary nitrogen-containing monomers include, for example, vinylpyrrolidone, vinylpyridine, vinylimidazol, dimethylaminoethyl(meth)acrylate, dimethylaminopropyl (meth)acrylate, diethylaminoethyl(meth)acrylate, dimethylaminoethyl(meth)acrylamide, dimethyl(meth) acrylamide and (meth)acrylonitrile.

The hydroxyl- or ether bond-containing monomers are hydroxyl- or ether bond-containing alkyl(meth)acrylates represented by the following general formula (4):

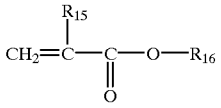

(4)

wherein $R_{15}$ represents a hydrogen atom or a methyl group; and $R_{16}$ represents a $C_1$–$C_6$ alkyl group having at least one hydroxyl group or a group of the following formula (5):

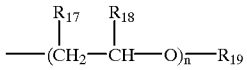

(5)

(wherein $R_{17}$ and $R_{18}$ each represent a hydrogen atom or a methyl group; $R_{19}$ represents a hydrogen atom or a $C_1$–$C_3$ alkyl group; and n is an integer of 1 to 60).

Such alkyl(meth)acrylates include hydroxyalkyl(meth) acrylates such as 2-hydroxyethyl(meth)acrylate, 2-hydroxypropyl(meth)acrylate, 1-methyl-2-hydroxyethyl (meth)acrylate, 2-hydroxybutyl(meth)acrylate and glycerol mono(meth)acrylate; polyethylene glycol mono(meth) acrylate, polypropylene glycol mono(meth)acrylate, methoxypolyethylene glycol mono(meth)acrylate, octyloxypolypropylene glycol mono(meth)acrylate, etc.

These tertiary nitrogen-containing monomers and the hydroxyl- or ether bond-containing monomers have detergent dispersing performance, i.e. an action of maintaining sludge particles suspended in lubricating oils.

While the weight ratio of the structural unit derived from the oil-soluble polymer (a) to the structural unit derived from the peroxy bond-containing copolymer (b) or (c) in the viscosity index improver may not particularly be limited, it is preferably in the range of 5/95 to 95/5 in view of overall performance of lubricating oils. In this case, the more the units derived from the oil-soluble polymer (a), the greater the thickening effect; whereas the more the units derived from the peroxy bond-containing copolymer (b) or (c), the greater the viscosity index.

Meanwhile, the weight average molecular weight of the polymer is preferably 10000 to 2000000, particularly 20000 to 500000, in view of thickening effect and shear stability.

Further, the viscosity index improver may be a mixture containing a linear polymer derived from the oil-soluble polymer (a), copolymer (b) or copolymer (c) in addition to the graft copolymer composed of the oil-soluble polymer (a) and the peroxy bond-containing copolymer (b) or (c). The mixture may contain such linear polymer which is by-produced in the process of producing the improver or which is added afterward. Viscosity index improvers containing such linear polymers exhibit the desired thickening effects, viscosity index improving effects, shear stabilizing effects, etc. based on the graft copolymers or based on the synergistic effects to be brought about the graft copolymers and the linear polymer or on the effects to be brought about by the linear polymers, respectively.

The amount of linear polymer in the polymer mixture may not particularly be limited. However, if the amount of the linear polymer is too much, excellent performances of the graft polymer are impaired, and the resulting lubricating oil composition containing it is liable to be separated into two phases. Accordingly, the linear polymer is added preferably in an amount of 90% by weight or less, particularly in an amount of 50% by weight or less.

Next, a process for producing the viscosity index improver will be described.

The process for producing a viscosity index improver comprises heating a mixture of the oil-soluble polymer (a) and the peroxy bond-containing copolymer (b) or (c) to such a temperature that the peroxy bond cleaves to effect grafting.

Further, the process for producing a viscosity index improver comprises a first step of polymerizing the monomer mixture (d) or (e) to form a peroxy bond-containing copolymer (b) or (c) and a second step of grafting a mixture of the oil-soluble polymer (a) and the peroxy bond-containing copolymer (b) or (c).

As a method for forming the peroxy bond-containing copolymer (b) or (c) in the first step, there may be mentioned the conventional radical polymerization technique employing a radical polymerization initiator. The method of polymerization may be any of bulk polymerization, solution polymerization, suspension polymerization and emulsion polymerization, and preferably solution polymerization or suspension polymerization is employed. This polymerization may be carried out in the presence of the oil-soluble polymer (a).

The solution employable in the solution polymerization may not particularly be limited and can be selected from various kinds of solvents such as saturated hydrocarbons, aromatic hydrocarbons, ketones, fatty acid esters and carbonic acid esters, as well as, lubricant base oils such as mineral oils and synthetic oils. Among these solvents, the lubricant base oils such as mineral oils are preferred, because the resulting solutions can be as such used as lubricating oil compositions.

In the suspension polymerization, it may be carried out employing an oil-soluble polymer (a) impregnated with a radical polymerization initiator and the monomer mixture (d) or (e). In this case, the oil-soluble polymer (a) preferably assumes a form of powder or pellet having a particle size of about 0.1 to 10 mm. The impregnation treatment is preferably carried out at a highest possible temperature. However, if the treatment is carried out at an extremely high temperature, the amount of unimpregnated copolymer is formed in a large amount to lower the graft efficiency in the second step. Accordingly, the impregnation treatment is carried out generally at a temperature at least SoC lower than the half-life (10 hours) temperature of the radical polymerization initiator such that the impregnation rate may be 50% by weight or more.

Suspension polymerization employs water as a medium and an ordinary dispersant, an emulsifier, etc. While the aqueous suspension may has a desired concentration, it is generally prepared by adding to water reaction components in an amount of 5 to 150 parts by weight of per 100 parts by weight of water.

The monomer mixture (d) or (e) may be of such a composition and in such an amount that it can form a peroxy bond-containing copolymer (b) or (c), respectively. Typically, the monomer mixture (d) or (e) is the same composition of monomers as that described with respect to the copolymer (b) or (c).

The polymerization can be carried out using a radical polymerization initiator. While the radical polymerization initiator may not particularly be limited, it is preferred to employ a polymerization initiator having a half-life (10 hours) temperature of 100° C. or lower. Typical polymerization initiators include, for example, t-butyl peroxypivalate, t-hexyl peroxypivalate, t-butyl peroxyneodecanoate, t-octyl peroxyneodecanoate, t-butyl peroxy-2-ethylhexanoate, t-amyl peroxy-2-ethylhexanoate, t-hexyl peroxy-2-ethylhexanoate, t-octyl peroxy-2-ethylhexanoate, t-butyl peroxyisobutyrate, lauroyl peroxide, benzoyl peroxide, 3,5,5-trimethylhexanoyl peroxide, diisobutyryl peroxide, diisopropyl peroxidicarbonate, di-2-ethylhexyl peroxidicarbonate, 1,1-bis(t-butylperoxy) cyclohexane, 1,1-bis(t-butylperoxy)3,3,5-trimethylcyclohexane and 2,2'-azobisisobutyronitrile. While the usage of radical polymerization initiator should be selected such that the polymer to be formed may have a desired molecular weight, usually it is preferably 0.01 to 5% by weight relative to the monomers.

The polymerization temperature and the polymerization time should be selected such that the peroxy bond of the peroxy bond-containing monomer does not cleave, and polymerization is preferably carried out at a temperature of 50 to 80° C. for 3 to 10 hours.

The weight average molecular weight of the peroxy bond-containing copolymer (b) or (c) to be prepared in the first step is preferably adjusted to be within the range of 5000 to 1000000, preferably in the range of 10000 to 500000, as described above. Further, a chain transfer agent may be used in the polymerization so as to achieve molecular weight adjustment.

The method for grafting the mixture of the oil-soluble polymer (a) and the peroxy bond-containing copolymer (b) or (c) in the second step includes preferably heating of the mixture in a solvent such as a mineral oil or melt kneading of the mixture with heating in the absence of solvent etc.. The oil-soluble polymer (a) may be added in the first step or at the beginning of the second step.

The grafting is carried out at such a temperature that peroxy bonds derived from the peroxy bond-containing copolymer (b) or peroxy bond-containing monomer in (c) cleave, and the temperature is preferably 80 to 300° C., more preferably 100 to 200° C.

Melt kneading methods include those employing the conventional kneaders such as a Banbury mixer, a pressure kneader, a Ko-kneader, a double-screw extruder and a mixing roll.

In the second step, while the weight ratio of the oil-soluble polymer (a) to the peroxy bond-containing copolymer (b) or (c) may not particularly be limited, it is preferably in the range of 5/95 to 95/5. Meanwhile, the weight average molecular weight of the polymer to be obtained is adjusted preferably to be within the range of 10000 to 2000000, more preferably within the range of 20000 to 500000.

Typical process for producing the viscosity index improver preferably includes the following three:

The first process will be described below. To a lubricant base oil are added the monomer mixture (d) or (e) and a radical polymerization initiator to effect copolymerization of the monomer mixture at such a temperature that the radical polymerization initiator decomposes and that the peroxy bond of the peroxy bond-containing monomer does not substantially cleave, and then the oil-soluble polymer (a) is added to the resulting mixture to be dissolved therein, followed by heating of the mixture to such a temperature that peroxy bonds derived from the peroxy bond-containing monomer cleave to effect grafting.

The second process will be described below. To a lubricant base oil are added the oil-soluble polymer (a), the monomer mixture (d) or (e) and a radical polymerization initiator to effect copolymerization of the monomer mixture at such a temperature that the radical polymerization initiator decomposes and that the peroxy bond of the peroxy bond-containing monomer does not substantially cleave, followed by heating of the mixture to such a temperature that the peroxy bond of the peroxy bond-containing monomer cleaves to effect grafting.

The third process will be described below. To an aqueous suspension of particles of the oil-soluble polymer (a) are added the monomer mixture (d) or (e) and a radical polymerization initiator, and the resulting mixture is heated under the condition where decomposition of the radical polymerization initiator substantially does not occur to impregnate the particulate oil-soluble polymer (a) with the monomer mixture and the radical polymerization initiator.

Subsequently, the resulting aqueous suspension is heated to such a temperature that the radical polymerization initiator decomposes and that the peroxy bond of the peroxy bond-containing monomer does not substantially cleave to effect copolymerization of the monomer mixture in the particulate oil-soluble polymer (a) and obtain a graft precursor (first step). This graft precursor is melt-kneaded at such a temperature that the peroxy bond cleaves to effect grafting (second step).

The first and second processes enjoy merits in that they give graft copolymers with high efficiency, and that viscosity index improvers can be obtained in the form of solution, eliminating the procedures of dissolving the polymers in lubricating oils. Meanwhile, the third process enjoys merits in that a graft copolymer with high graft efficiency can be obtained, and that a high-purity polymer can be obtained, leading to reduction in the transportation cost. The polymer to be obtained according to the third process may as necessary be dissolved in a solvent such as a mineral oil to be prepared into a form of lubricating oil composition.

Further, the viscosity index improver may be synthesized to have a molecular weight larger than the value to be expected in the final use and then subjected to mechanical or thermal molecular weight reduction by conventional procedures in the art to adjust the molecular weight to be within the desired range.

After production of the viscosity index improver, the improver may further be grafted, as necessary, with a monomer having detergent dispersing performance by conventional procedures.

The amount of graft copolymer to be contained in the viscosity index improver can be measured according to the ordinary fractional precipitation and is expressed in terms of graft efficiency. Graft efficiency of the copolymer (b) or (c) to the oil-soluble polymer (a) is preferably 20% or more, more preferably 50% or more.

The amount of graft copolymer can also be expressed by the number of branch chains (branch number) per molecule of the polymer to be measured using a gel permeation chromatograph (GPC-LALLS) equipped with a light scattering detector. The greater branch number means the greater degree of grafting. The branch number is preferably 1 or more.

Next, the lubricating oil composition will be described.

While the lubricating oil composition is prepared by incorporating the viscosity index improver into a lubricant base oil, the composition may contain other components such as lubricating oil additives and the like which are generally added to lubricating oils.

Such other components include, for example, other known viscosity index improvers including oily agents such as long-chain fatty acids; abrasion preventives such as phosphoric acid esters and metal dithiophosphates; extreme pressure additives such as organic sulfurous compounds and organic molybdenum compounds; rust preventives such as carboxylic acids, sulfonic acid salts and phosphoric acid salts; detergents such as metal salts including sulfonates, phenates and phosphonates; dispersants such as succinimide; pour point depressants such as poly(meth)acrylate and condensates of chlorinated paraffin with naphthalene or phenol; antioxidants such as zinc thiophosphate, amines and phenols; and poly(meth)acrylates.

Referring to lubricating oil compositions containing the viscosity index improvers at high concentration, they are used as component lubricating oil additives if they contain the viscosity index improvers only or as package lubricating oil additives if they contain various kinds of additives. A lubricating oil composition containing various kinds of additives adjusted to desired concentrations respectively are used as lubricating oils such as gasoline engine oils, diesel engine oils, gear oils, transmission oils, hydraulic oils, power steering oils and shock-absorbing oils.

The lubricant base oil can be exemplified by the conventional mineral oils to be obtained by purifying crude oils, for example, paraffinic and naphthenic neutral oils, hydrocarbon series synthetic lubricating oils, ester series synthetic lubricating oils, MLDW oils and high-viscosity index mineral oils containing paraffin isomers, or mixtures of these oils, and preferably neutral oils.

The amount of viscosity index improver in the lubricating oil composition, in terms of concentrate, is in such a range that the composition can be handled with ease, typically in an amount of 10 to 60% by weight. The amount of viscosity index improver actually used in a lubricating oil is adjusted such that the oil may have a desired grade of viscosity, typically in the range of 0.5 to 20% by weight, for example, 2 to 4% by weight.

As described above, the viscosity index improvers and the processes for producing the same in the above embodiments enjoy the following merits:

(1) The viscosity index improvers have excellent viscosity index improving performances and thickening effects, since they each contain a graft copolymer consisting of the structural unit formed by the specific oil-soluble polymer (a) and the structural unit formed by the copolymer (b) or (c), so that a high-performance lubricating oil can be obtained by adding the viscosity index improver in a small amount to a lubricating oil;

(2) The polymers assume a structure of graft copolymer, and if the side chains of the graft copolymer are severed, the backbone chain remains intact to maintain viscosity at a predetermined level. Accordingly, the viscosity index improvers show excellent shear stability when subjected to high shearing actions;

(3) Since the respective polymers are chemically bound to one another to assume a graft structure, the viscosity index improvers do not undergo phase separation in lubricating oils to show stability over extended periods;

(4) The viscosity index improvers show, based mainly on the peroxy bond-containing copolymer (b) and (c), excellent pour point depressing performance or excellent low-temperature fluidity;

(5) The viscosity index improvers can impart to lubricating oils, based on the peroxy bond-containing copolymer (c), excellent detergent dispersing performance of dispersing sludge particles in the lubricating oils; and (6) According to the process for producing the viscosity index improver of the present invention, the above-described viscosity index improvers containing the graft copolymers can be produced easily and with high graft efficiency values, respectively.

BEST MODE FOR CARRYING OUT THE INVENTION

Next, the present invention will be described by way of nonlimitative examples. It should be noted here that % in the following description and tables means all % by weight. Further, the molecular weight means the weight average molecular weight (Mw) determined by means of gel permeation chromatography (GPC) using tetrahydrofuran as a developing solvent.

Incidentally, abbreviations used in the following description and tables are as shown below:

| | |
|---|---|
| MEC: | t-butyl peroxymethacryloyloxyethylcarbonate |
| AC: | t-butyl peroxyallylcarbonate |
| IPF: | t-butyl peroxyisopropylfumarate |
| MMA: | methyl methacrylate |
| BMA: | butyl methacrylate |
| IDMA: | isodecyl methacrylate |
| LMA: | lauryl methacrylate |
| CMA: | cetyl methacrylate |
| SMA: | stearyl methacrylate |
| EMA: | eicosyl methacrylate |
| ST: | styrene |

-continued

| | |
|---|---|
| DMF: | dimethyl fumarate |
| DBF: | dibutyl fumarate |
| DDF: | didodecyl fumarate |
| DMM: | dimethyl maleate |
| DBM: | dibutyl maleate |
| DDM: | didodecyl maleate |
| VAc: | vinyl acetate |
| VD: | vinyl dodecanoate |
| NVP: | N-vinyl-2-pyrrolildone |
| DMAEMA: | dimethylaminoethyl methacrylate |
| HEMA: | hydroxyethyl methacrylate |
| PE350: | polyethylene glycol monomethacrylate (trade name: BLEMMER PE-350, Nippon Oil & Fats Co., Ltd.) |
| THPO: | 3,5,5-trimethyhexanoyl peroxide |
| LPO: | lauroyl peroxide |
| BPO: | benzoyl peroxide |
| NDM: | n-dodecylmercaptan |
| SDC1: | [polystyrene-hydrogenated polyisoprene] diblock copolymer (styrene content: 35%; molecular weight: 130000) |
| SDC2: | [hydrogenated polyisoprene-polystyrene-hydrogenated polyisoprene] triblock copolymer (styrene content: 30%; molecular weight: 170000) |
| SDC3: | [polystyrene-hydrogenated polyisoprene-polystyrene] triblock copolymer (styrene content: 40%; molecular weight: 110000) |
| SDC4: | [polystyrene-hydrogenated polybutadiene-polystyrene] triblock copolymer (styrene content: 20%; molecular weight: 90000) |
| OCP1: | ethylene/propylene random copolymer (ethylene content: 55%; molecular weight: 80000) |
| OCP2: | ethylene/1-butene random copolymer (ethylene content: 47%; molecular weight: 130000) |
| HPB: | hydrogenated polybutadiene (molecular weight: 95000) |
| HPI: | hydrogenated polyisoprene (molecular weight: 85000) |
| SPI: | star-shaped copolymer having 8 hydrogenated polyisoprene chains on an average bound to a polydivinyl benzene nucleus (hydrogenated polyisoprene chain molecular weight: 85000) |
| PIB: | polyisobutylene (molecular weight: 53000) |
| EDMA: | ethylene/dodecyl methacrylate copolymer (ethylene content: 55%; molecular weight: 105000) |
| EVD: | ethylene/vinyl dodecanoate copolymer (ethylene content: 60%; molecular weight: 140000) |

EXAMPLE 1

To a 1-liter reaction vessel equipped with a stirrer, a dropping funnel, a thermometer, a purge gas inlet and a water-cooled condenser was charged 150 g of 100 neutral oil (Super Oil AL, Nippon Oil Co., Ltd., prepared by purifying final petroleum distillate), and after the oil was heated to 70° C. under nitrogen gas blowing, a mixture of 2 g of MEC, 10 g of MMA, 61 g of IDMA, 15 g of CMA, 8 g of SMA, 4 g of EMA and 1 g of THPO was added dropwise thereto with stirring over 2 hours. After completion of dropping, stirring was continued as such for 6 hours to complete polymerization and give a peroxy bond-containing copolymer. The concentration of the polymer in the solution was 40%, and the weight average molecular weight (Mw) of the polymer was 149000.

Next, a mixture of 110 g of an oil-soluble polymer SDC dissolved in 15 g of 100 neutral oil was added to this solution to effect reaction with stirring at 120° C. for 6 hours under nitrogen gas blowing to give a homogeneous, transparent and viscous graft copolymer solution. The weight average molecular weight of the polymer was 238000, and the concentration of the polymer in the solution was 40%. The branch number per molecule of the polymer also measured by using GPC-LALLS (Toso) was found to be 1.6. Further, the polymer was isolated by means of rubber membrane dialysis employing a petroleum ether as an extraction solvent and dissolved in toluene, and the resulting solution was then subjected to fractional precipitation by adding methyl ethyl ketone thereto slowly to find that the content of the graft copolymer in the polymer was 36%.

When the 100 neutral oil solution containing 40% of the polymer thus obtained was maintained at 100° C. so as to examine its stability, the solution underwent no phase separation even after 100 days.

To the polymer solution obtained was added 100 neutral oil (kinetic viscosity at 100° C.: 4.4 cSt; viscosity index: 101) to adjust the kinetic viscosity at 100° C. to be about 11.5 cSt. The polymer content of the solution was 2.9%. The polymer content represents the thickening effect, and the smaller the polymer content is, the higher is the thickening effect. Further, the following tests were carried out employing this solution. The results are summarized in Table 1.

Kinetic Viscosity and Viscosity Index

Kinetic viscosity was measured at 40° C. and 100° C. in accordance with JIS K-2283 to calculate viscosity index based on the thus measured values. The greater the viscosity index is, the smaller is the temperature-dependent viscosity change and the higher is the stability.

Pour Point

Pour point was measured in accordance with JIS K- 2269. The lower the pour point is, the better is the fluidity of the lubricating oil at low temperatures.

Shear Stability

Shear stability was measured at 100° C. in accordance with ASTM D-3945 to calculate shear stability index (SSI) using the following expression:

$$SSI=[(Vu-Vs)/(Vu-Vo)]\times 100,$$

wherein Vu represents viscosity before shearing; $V_s$ represents viscosity after shearing; and Vo represents viscosity of the base oil.

The smaller the shear stability index is, the better the shear stability of the lubricating oil.

EXAMPLES 2 TO 20

Graft copolymers were synthesized in the same manner as in Example 1 except that the monomer composition of the peroxy bond-containing copolymer (B) and the amount of the oil soluble polymer (A) were changed as shown in Tables 1 and 2. In the same manner as in Example 1, the graft copolymers were subjected to the stability test, and further a solution having a kinetic viscosity at 100° C. of about 11.5 cSt was prepared by adding 100 neutral oil to each polymer solution and subjected to the performance test. The results of polymerization and of the tests are shown in Tables 1 to 4.

TABLE 1

| Example | 1 | 2 | 3 | 4 | 5 |
|---|---|---|---|---|---|
| Copolymer B | | | | | |
| Loading (g) | | | | | |
| Monomer | | | | | |
| MEC | 2 | 1 | 4 | 30 | 5 |
| MMA | 10 | 5 | 16 | — | 10 |
| BMA | — | 15 | — | 20 | 15 |
| IDMA | 61 | — | 40 | — | — |

TABLE 1-continued

| Example | 1 | 2 | 3 | 4 | 5 |
|---|---|---|---|---|---|
| LMA | — | 60 | 10 | 35 | 40 |
| CMA | 15 | 12 | 10 | — | 12 |
| SMA | 8 | 7 | 20 | 10 | 6 |
| EMA | 4 | — | — | 5 | 2 |
| NVP | — | — | — | — | 5 |
| DMAEMA | — | — | — | — | 5 |
| Initiator | | | | | |
| THPO | 1 | 1 | 2 | — | 1.5 |
| LPO | — | — | — | 0.5 | — |
| BPO | — | — | — | — | — |
| Base oil | 150 | 150 | 150 | 150 | 150 |
| Solid content (%) | 40 | 40 | 40 | 40 | 40 |
| Mw × $10^{-4}$ | 14.9 | 15.5 | 9.8 | 23.3 | 14.1 |
| Polymer A | | | | | |
| Loading (g) | | | | | |
| SDC1 | 10 | — | — | — | 20 |
| SDC2 | — | 10 | — | — | — |
| OCP1 | — | — | 10 | — | — |
| OCP2 | — | — | — | 20 | — |
| Base oil | 15 | 15 | 15 | 30 | 30 |
| Copolymer formed | | | | | |
| Concentration (%) | 40 | 40 | 40 | 40 | 40 |
| Mw × $10^{-4}$ | 23.8 | 25.4 | 16.4 | 33.3 | 21.9 |
| Stability (day) | >100 | >100 | >100 | >100 | >100 |
| Polymer content (%) | 2.9 | 2.7 | 3.4 | 2.2 | 2.5 |
| Viscosity index | 231 | 225 | 222 | 219 | 212 |
| Pour point (° C.) | −40 | −42.5 | −40 | −35 | −42.5 |
| SSI | 29 | 28 | 25 | 32 | 31 |

TABLE 2

| Example | 6 | 7 | 8 | 9 | 10 |
|---|---|---|---|---|---|
| Copolymer B | | | | | |
| Loading (g) | | | | | |
| Monomer | | | | | |
| MEC | 5 | 5 | 5 | — | — |
| IPF | — | — | — | 5 | 10 |
| MMA | 10 | 10 | 5 | 10 | 10 |
| BMA | — | 15 | 10 | 10 | — |
| IDMA | 55 | — | — | — | 55 |
| LMA | — | 40 | 40 | 40 | — |
| CMA | 12 | 15 | 15 | 15 | 11 |
| SMA | 6 | — | — | — | 6 |
| EMA | 2 | 10 | 10 | 10 | 3 |
| ST | — | — | 10 | — | — |
| DBF | — | — | — | 5 | — |
| NVP | 10 | — | — | 5 | 5 |
| DMAEMA | — | 5 | 5 | — | — |
| Initiator | | | | | |
| THPO | 1 | — | 1.3 | — | 1 |
| LPO | — | 1 | — | 2 | — |
| BPO | — | — | — | — | — |
| Base oil | 150 | 150 | 150 | 150 | 150 |
| Solid content (%) | 40 | 40 | 40 | 40 | 40 |
| Mw × $10^{-4}$ | 16.8 | 17.4 | 13.5 | 11.4 | 16.1 |
| Polymer A | | | | | |
| Loading (g) | | | | | |
| HPB | 15 | — | — | — | — |
| HPI | — | 15 | — | — | — |
| PIB | — | — | 10 | — | — |
| EDMA | — | — | — | 20 | — |
| EVD | — | — | — | — | 20 |
| Base oil | 22.5 | 22.5 | 15 | 30 | 30 |
| Copolymer formed | | | | | |
| Concentration (%) | 40 | 40 | 40 | 40 | 40 |
| Mw × $10^{-4}$ | 25.6 | 26.7 | 19.5 | 19.7 | 20.4 |

TABLE 2-continued

| Example | 6 | 7 | 8 | 9 | 10 |
|---|---|---|---|---|---|
| Stability (day) | >100 | >100 | >100 | >100 | >100 |
| Polymer content (%) | 2.7 | 2.7 | 3.1 | 2.6 | 2.7 |
| Viscosity index | 231 | 228 | 211 | 216 | 210 |
| Pour point (° C.) | −35 | −40 | −40 | −32.5. | −32.5 |
| SSI | 29 | 30 | 31 | 27 | 26 |

TABLE 3

| Example | 11 | 12 | 13 | 14 | 15 |
|---|---|---|---|---|---|
| Copolymer B | | | | | |
| Loading (g) | | | | | |
| Monomer | | | | | |
| MEC | 2 | 4 | — | — | — |
| AC | — | — | 5 | 3 | 5 |
| MMA | 8 | 9 | — | — | — |
| BMA | — | — | 10 | 10 | — |
| IDMA | 33 | 59 | 30 | 30 | — |
| LMA | 18 | — | 20 | 20 | — |
| CMA | 20 | 13 | 14 | 12 | — |
| SMA | 9 | 5 | 11 | 5 | — |
| EMA | — | 2 | — | — | — |
| ST | — | — | 5 | — | — |
| DBF | — | — | — | 10 | — |
| DMM | — | — | — | — | 5 |
| DBM | — | — | — | — | 5 |
| DDM | — | — | — | — | 10 |
| VAc | — | — | — | — | 35 |
| VD | — | — | — | — | 35 |
| NVP | — | — | — | — | 5 |
| HEMA | — | 5 | 5 | 10 | — |
| PE350 | 10 | 3 | — | — | — |
| Initiator | | | | | |
| THPO | 1 | 1 | 0.7 | 2 | 2 |
| Base oil | 150 | 150 | 100 | 100 | 100 |
| Solid content (%) | 40 | 40 | 50 | 50 | 50 |
| Mw × $10^{-4}$ | 18.3 | 17.6 | 25.1 | 18.4 | 18.6 |
| Polymer A | | | | | |
| Loading (g) | | | | | |
| SDC1 | — | — | 50 | — | — |
| SDC2 | — | — | — | 5 | — |
| SDC4 | — | 10 | — | — | — |
| OCP1 | — | — | — | — | 10 |
| SPI | 10 | — | — | — | — |
| Base oil | 15 | 15 | 50 | 5 | 10 |
| Copolymer formed | | | | | |
| Concentration (%) | 40 | 40 | 50 | 50 | 60 |
| Mw × $10^{-4}$ | 35.3 | 24.4 | 17.3 | 28.2 | 29.1 |
| Stability (day) | >100 | >100 | >100 | >100 | >100 |
| Polymer content (%) | 2.8 | 2.8 | 2.1 | 3.1 | 2.8 |
| Viscosity index | 224 | 229 | 192 | 231 | 227 |
| Pour point (° C.) | −40 | −30 | −40 | −40 | −35 |
| SSI | 32 | 29 | 19 | 30 | 27 |

TABLE 4

| Example | 16 | 16 | 17 | 18 | 20 |
|---|---|---|---|---|---|
| Copolymer B | | | | | |
| Loading (g) | | | | | |
| Monomer | | | | | |
| MEC | — | 2 | 3 | 1 | 5 |
| AC | — | — | 4 | — | — |
| IPF | 3 | — | — | 3 | — |
| MMA | — | — | 6 | — | 3 |
| BMA | — | — | — | 10 | 3 |
| IDMA | — | — | 57 | 49 | 50 |

TABLE 4-continued

| Example | 16 | 16 | 17 | 18 | 20 |
|---|---|---|---|---|---|
| CMA | — | — | 10 | 15 | 15 |
| SMA | 10 | 6 | 7 | 8 | 8 |
| EMA | 7 | 4 | 3 | 4 | 4 |
| ST | — | — | — | — | 4 |
| DMF | 10 | 10 | — | — | — |
| DBM | 10 | 20 | — | — | 3 |
| DDF | 45 | 48 | — | — | — |
| NVP | — | 5 | 5 | — | — |
| DMAEMA | 15 | 5 | 5 | — | — |
| HEMA | — | — | — | 2 | 5 |
| PE350 | — | — | — | 8 | — |
| Initiator | | | | | |
| LPO | 1 | 1 | 1 | 2 | 2 |
| Base oil | 100 | 150 | 150 | 67 | 67 |
| Solid content (%) | 50 | 40 | 40 | 60 | 60 |
| Mw × $10^{-4}$ | 22.9 | 17.7 | 16.5 | 24.4 | 23.5 |
| Polymer A | | | | | |
| Loading (g) | | | | | |
| SDC1 | — | 20 | — | 10 | — |
| SDC2 | — | 20 | — | — | 10 |
| SDC3 | — | — | 20 | — | — |
| OCP2 | — | — | 20 | — | — |
| HPB | — | — | — | 10 | — |
| HPI | 10 | — | — | — | 10 |
| Base oil | 10 | 60 | 60 | 13 | 13 |
| Copolymer formed | | | | | |
| Concentration (%) | 60 | 40 | 40 | 60 | 60 |
| Mw × $10^{-4}$ | 29.6 | 18.1 | 19.5 | 23.3 | 22.1 |
| Stability (day) | >100 | >100 | >100 | >100 | >100 |
| Polymer content (%) | 2.7 | 1.9 | 1.8 | 2.3 | 2.4 |
| Viscosity index | 219 | 196 | 194 | 225 | 223 |
| Pour point (° C.) | −32.5 | −40 | −40 | −40 | −40 |
| SSI | 28 | 20 | 18 | 25 | 24 |

EXAMPLE 21

To a 1-liter vessel equipped with a stirrer, a dropping funnel, a thermometer, a purge gas inlet and a water-cooled condenser were charged 36 g of 100 neutral oil, 43 g of SDC1 as the oil-soluble polymer, 2 g of MEC, 10 g of MMA, 61 g of IDMA, 15 g of CMA, 8 g of SMA and 4 g of EMA, and the resulting mixture was heated to 70° C. with stirring under nitrogen gas blowing to prepare a solution, to which a mixture of 2 g of THPO and 178.5 g of 100 neutral oil was added dropwise over 2 hours. After completion of dropping, stirring was continued as such for 6 hours to complete polymerization and give a 40% solution of the mixture of the peroxy bond-containing copolymer and the oil-soluble polymer.

Further, this solution was allowed to react at 120° C. with stirring under nitrogen gas blowing for 6 hours to give a homogeneous, transparent and viscous graft copolymer solution. The concentration of the polymer in the solution was 40%, and the weight average molecular weight of the polymer was 136000. The branch number per molecule of the polymer measured by using GPC-LALLS was found to be 2.2. Further, the content of the graft copolymer in the polymer measured by fractional precipitation was 48%.

In the same manner as in Example 1, the stability test was carried out using a 100 neutral oil solution containing 40% of the polymer obtained, and further a solution having a kinetic viscosity at 100° C. of about 11.5 cSt was prepared by adding 100 neutral oil to the polymer solution and subjected to the performance test. The results are summarized in Table 5.

EXAMPLES 22 TO 30

Graft copolymers were synthesized in the same manner as in Example 21 except that the monomer composition of the copolymer (B), the oil-soluble polymer (A) and loading were changed as shown in Table 3, and tests were carried out in the same manner as in Example 21. Results of polymerization and of the tests are shown in Tables 5 and 6.

TABLE 5

| Example | 21 | 22 | 23 | 24 | 25 |
|---|---|---|---|---|---|
| Copolymer B | | | | | |
| Loading (g) | | | | | |
| Monomer | | | | | |
| MEC | 2 | 3 | 4 | 30 | — |
| IPF | — | — | — | — | 5 |
| MMA | 10 | 10 | 6 | — | — |
| BMA | — | — | — | 20 | — |
| IDMA | 61 | 60 | 40 | — | — |
| LMA | — | — | 10 | 15 | — |
| CMA | 15 | 15 | 10 | — | 1 0 |
| SMA | 8 | 8 | 20 | 10 | — |
| EMA | 4 | 4 | — | 5 | 5 |
| ST | — | — | 10 | 20 | — |
| DMF | — | — | — | — | 10 |
| DBM | — | — | — | — | 10 |
| DDF | — | — | — | — | 50 |
| NVP | — | — | — | — | 5 |
| DMAEMA | — | — | — | — | 5 |
| Initiator | | | | | |
| THPO | 2 | 2 | 2 | — | 1.5 |
| LPO | — | — | — | 0.5 | — |
| BPO | — | — | — | — | — |
| Polymer A | | | | | |
| Loading (g) | | | | | |
| SDC1 | 43 | — | — | — | — |
| SDC2 | — | — | — | — | — |
| SDC3 | — | — | 25 | — | — |
| SDC4 | — | — | — | — | 67 |
| OCP1 | — | 43 | — | — | — |
| OCP2 | — | — | — | 25 | — |
| Base oil | 214.5 | 214.5 | 187.5 | 187.5 | 250 |
| Copolymer formed | | | | | |
| Concentration (%) | 40 | 40 | 40 | 40 | 40 |
| Mw × $10^{-4}$ | 19.8 | 18.4 | 22.4 | 23.3 | 16.9 |
| Stability (day) | >100 | >100 | >100 | >100 | >100 |
| Polymer content (%) | 2.9 | 2.7 | 3.4 | 2.2 | 2.5 |
| Viscosity index | 211 | 205 | 222 | 219 | 198 |
| Pour point (° C.) | −42.5 | −37.5 | −35 | −35 | −30 |
| SSI | 19 | 21 | 25 | 27 | 14 |

TABLE 6

| Example | 26 | 27 | 28 | 29 | 30 |
|---|---|---|---|---|---|
| Copolymer B | | | | | |
| Loading (g) | | | | | |
| Monomer | | | | | |
| MEC | — | 3 | 2 | — | 10 |
| AC | 5 | — | — | 5 | — |
| MMA | — | 10 | 5 | 10 | 10 |
| BMA | — | 15 | 10 | 10 | — |
| IDMA | — | — | — | — | 55 |
| LMA | — | 42 | 43 | 40 | — |
| CMA | — | 15 | 15 | 15 | 11 |
| SMA | — | — | — | — | 6 |
| EMA | — | 10 | 10 | 10 | 3 |
| ST | — | — | 10 | — | — |
| DMM | 5 | — | — | — | — |
| DBM | 5 | — | — | — | — |
| DDM | 10 | — | — | — | — |
| VAc | 30 | — | — | — | — |
| VD | 35 | — | — | — | — |
| NVP | 10 | — | — | — | — |
| DMAEMA | — | 5 | 5 | — | — |

TABLE 6-continued

| Example | 26 | 27 | 28 | 29 | 30 |
|---|---|---|---|---|---|
| HEMA | — | — | — | 10 | — |
| PE350 | — | — | — | — | 5 |
| Initiator | | | | | |
| THPO | 1 | — | 1.3 | — | 1 |
| LPO | — | 1 | — | 2 | — |
| BPO | — | — | — | — | — |
| Polymer A | | | | | |
| Loading (g) | | | | | |
| HPB | 11 | — | — | — | — |
| HPI | — | 15 | — | — | — |
| PIB | — | — | 10 | — | — |
| EDMA | — | — | — | 20 | — |
| EVD | — | — | — | — | 20 |
| Base oil | 167 | 115 | 257 | 180 | 180 |
| Copolymer formed | | | | | |
| Concentration (%) | 40 | 50 | 30 | 40 | 40 |
| Mw × $10^{-4}$ | 28.6 | 24.7 | 20.5 | 18.9 | 19.1 |
| Stability (day) | >100 | >100 | >100 | >100 | >100 |
| Polymer content (%) | 2.7 | 2.7 | 3.1 | 2.9 | 2.8 |
| Viscosity index | 208 | 221 | 210 | 219 | 221 |
| Pour point (° C.) | −30 | −40 | −37.5 | −40 | −40 |
| SSI | 29 | 27 | 27 | 25 | 26 |

EXAMPLE 31

To a 2-liter-capacity reaction vessel equipped with a stirrer, a dropping funnel, a thermometer, a purge gas inlet and a water-cooled condenser was charged 550 g of water, and further 0.6 g of polyvinyl alcohol was dissolved therein as a suspending agent, followed by addition of 100 g of particulate SDC1 (particle diameter: 1 to 2 mm) was added as the oil-soluble polymer to be dispersed therein with stirring. To the resulting dispersion were added 1 g of MEC, 10 g of MMA, 62 g of IDMA, 15 g of CMA, 8 g of SMA, 4 g of EMA, 0.5 g of n-dodecylmercaptan and 1 g of THPO, and the resulting mixture was stirred. The mixture was then heated to 60° C. under nitrogen gas blowing to effect impregnation of the oil-soluble polymer with the radical polymerization initiator and the vinyl monomer with stirring for one hour. Subsequently, the mixture was heated to 70° C., and stirring was continued at the same temperature for 6 hours to complete polymerization and give a graft precursor in which the peroxy bond-containing copolymer is present in the oil-soluble polymer.

The graft precursor was filtered out, washed with water, dried and then subjected to kneading over a Banbury mixer (Toyo Seiki Seisakusho) at 140° C. at 100 rpm for one hour to obtain a graft copolymer having an average molecular weight of 130000. The branch number per molecule of the polymer measured by using GPC-LALLS was found to be 3.1. Further, the content of the graft copolymer in the polymer measured by fractional precipitation was 68%.

When 10 g of the polymer thus obtained was added to 90 g of 100 neutral oil and the resulting mixture was heated, the polymer dissolved completely in the oil to give a homogeneous, transparent and viscous liquid.

In the same manner as in Example 1, the resulting solution was subjected to the stability test, and further a solution having a kinetic viscosity at 100° C. of about 11.5 cSt was prepared by adding 100 neutral oil to the polymer solution and subjected to the performance test. The results are summarized in Table 7.

EXAMPLES 32 TO 40

Graft copolymers were synthesized in the same manner as in Example 31 except that the monomer composition of the copolymer (B), the oil-soluble polymer (A) and loading were changed as shown in Table 4, and tests were carried out in the same manner as in Example 31. Results of polymerization and of the tests are shown in Tables 7 and 8.

TABLE 7

| Example | 31 | 32 | 33 | 34 | 35 |
|---|---|---|---|---|---|
| Copolymer B | | | | | |
| Loading (g) | | | | | |
| Monomer | | | | | |
| MEC | 1 | 2 | — | — | — |
| AC | — | — | 2 | 10 | — |
| IPF | — | — | — | — | 2 |
| MMA | 10 | 5 | 18 | — | — |
| BMA | — | 14 | — | 10 | — |
| IDMA | 62 | — | 40 | 10 | — |
| LMA | — | 60 | 10 | 45 | — |
| CMA | 15 | 12 | 10 | 10 | 8 |
| SMA | 8 | 7 | 20 | 10 | — |
| EMA | 4 | — | — | 5 | 5 |
| ST | — | — | — | — | 10 |
| DMF | — | — | — | — | 10 |
| DBF | — | — | — | — | 10 |
| DDF | — | — | — | — | 50 |
| NVP | — | — | — | — | 5 |
| Initiator | | | | | |
| THPO | 1 | — | — | 2 | 2 |
| LPO | — | — | — | — | — |
| BPO | — | 2 | 1 | — | 3 |
| NDM | 0.5 | 0.5 | 0.3 | 0.7 | — |
| Polymer A | | | | | |
| Loading (g) | | | | | |
| SDC1 | 100 | — | — | — | — |
| SDC2 | — | — | — | — | — |
| SDC3 | — | 100 | — | — | — |
| SDC4 | — | — | — | — | 50 |
| OCP1 | — | — | 300 | — | — |
| OCP2 | — | — | — | — | — |
| SPI | — | — | — | 100 | — |
| Copolymer formed | | | | | |
| Mw × $10^{-4}$ | 13.0 | 15.8 | 8.8 | 14.1 | 9.6 |
| Stability (day) | >100 | >100 | >100 | >100 | >100 |
| Polymer content (%) | 2.2 | 1.5 | 1.9 | 2.7 | 2.9 |
| Viscosity index | 188 | 182 | 178 | 189 | 193 |
| Pour point (° C.) | −40 | −35 | −40 | −30 | −32.5 |
| SSI | 14 | 21 | 16 | 18 | 25 |

TABLE 8

| Example | 36 | 37 | 38 | 39 | 40 |
|---|---|---|---|---|---|
| Copolymer B | | | | | |
| Loading (g) | | | | | |
| Monomer | | | | | |
| MEC | 3 | 2 | 3 | 2 | — |
| AC | — | — | — | — | 5 |
| IPF | — | — | — | 1 | — |
| MMA | 5 | 10 | 6 | — | — |
| BMA | 5 | — | — | 10 | — |
| IDMA | 23 | — | 57 | 50 | — |
| LMA | 15 | 49 | — | — | — |
| CMA | 19 | 15 | 10 | 15 | — |
| SMA | 10 | 8 | 7 | 8 | — |
| EMA | — | 4 | 3 | 4 | — |
| DBF | 10 | — | — | — | — |
| DMM | — | — | — | — | 5 |
| DBM | — | — | — | — | 5 |
| DDM | — | — | — | — | 10 |
| VAc | — | — | — | — | 35 |
| VD | — | — | — | — | 35 |
| NVP | — | 5 | 5 | — | — |

TABLE 8-continued

| Example | 36 | 37 | 38 | 39 | 40 |
|---|---|---|---|---|---|
| DMAEMA | — | 5 | 5 | — | — |
| HEMA | 6 | — | — | 2 | 5 |
| PE350 | 4 | — | — | 8 | — |
| Initiator | | | | | |
| THPO | — | — | 5 | — | — |
| LPO | — | — | — | 2 | 2 |
| BPO | 4 | 4 | — | — | — |
| NDM | — | — | — | 0.4 | 0.4 |
| Polymer A | | | | | |
| Loading (g) | | | | | |
| SDC1 | — | 20 | — | — | — |
| SDC2 | 100 | 20 | — | — | — |
| OCP1 | — | — | 20 | — | — |
| OCP2 | — | — | 20 | — | — |
| HPB | — | — | — | 50 | — |
| HPI | — | — | — | 50 | — |
| SPI | — | — | — | — | — |
| PIB | — | — | — | 100 | — |
| EDMA | — | — | — | — | 50 |
| EVD | — | — | — | — | 50 |
| Copolymer formed | | | | | |
| Mw × $10^{-4}$ | 10.2 | 7.5 | 8.6 | 6.7 | 13.2 |
| Stability (day) | >100 | >100 | >100 | >100 | >100 |
| Polymer content (%) | 2.6 | 2.3 | 2.6 | 3.1 | 2.8 |
| Viscosity index | 185 | 201 | 204 | 194 | 184 |
| Pour point (° C.) | −40 | −37.5 | −40 | −40 | −35 |
| SSI | 15 | 19 | 21 | 16 | 17 |

Comparative Example 1

To a 1-liter reaction vessel equipped with a stirrer, a dropping funnel, a thermometer, a purge gas inlet and a water-cooled condenser was charged 150 g of 100 neutral oil, and after the oil was heated to 70° C. under nitrogen gas blowing, a mixture of 10 g of MMA, 63 g of IDMA, 15 g of CMA, 8 g of SMA, 4 g of EMA and 1 g of THPO was added dropwise thereto with stirring over 2 hours. After completion of dropping, stirring was continued as such for 6 hours to complete polymerization and give a copolymer. The concentration of the polymer in the solution was 40%, and the weight average molecular weight (Mw) of the polymer was 158000.

In the same manner as in Example 1, the resulting polymer solution was subjected to the stability test, and further a solution having a kinetic viscosity at 100° C. of about 11.5 cSt was prepared by adding 100 neutral oil to the polymer solution and subjected to the performance test. The results are shown in Table 9.

Comparative Example 2

To 100 g of the solution containing 40% of the polymer obtained in Comparative Example 1 were added 8 g of SDC1, 12 g of 100 neutral oil and 1 g of t-butyl peroxybenzoate, and the resulting mixture was reacted at 120° C. under nitrogen gas blowing for 6 hours. The polymer had a weight average molecular weight Mw of 102000, and the branch number per molecule of the polymer was 0.3. Further, the content of the graft copolymer in the polymer was 5%.

The polymer solution obtained was subjected to the performance test in the same manner as in Example 1. The results are shown in Table 9.

Comparative Example 3

To a 1-liter reaction vessel equipped with a stirrer, a dropping funnel, a thermometer, a purge gas inlet and a water-cooled condenser were charged 180 g of 100 neutral oil and 20 g of OCP1 to prepare a solution, and after the solution was heated to 70° C. under nitrogen gas blowing, a mixture of 10 g of MMA, 61 g of IDMA, 15 g of CMA, 8 g of SMA and 4 g of EMA and 1 g of THPO was added dropwise thereto over 2 hours. After completion of dropping, stirring was continued as such for 6 hours, followed by addition of 0.5 g of t-butyl peroxybenzoate thereto. The resulting mixture was then heated to 130° C., and stirring was continued for 6 hours with addition of 0.5 g of t-butyl peroxygenzoate after 1 hour and 3 hours in the meantime to give a copolymer. The concentration of the polymer in the solution was 40%, and the weight average molecular weight of the polymer was 178000. The branch number per molecule of the polymer was 0.8. Further, the content of the graft copolymer in the polymer was 12%.

The polymer solution obtained was subjected to the performance test in the same manner as in Example 1. The results are shown in Table 9.

Comparative Examples 4 to 7

The performance test described in Example 1 was carried out using SDC 1 (Comparative Example 4), OCP1 (Comparative Example 5), HPB (Comparative Example 6) or PIB (Comparative Example 7) singly. The results are shown in Table 9.

TABLE 9

| Comparative Example | 1 | 2 | 3 | 4 | 5 | 6 | 7 |
|---|---|---|---|---|---|---|---|
| Stability (day) | >100 | 20 | >100 | >100 | >100 | >100 | >100 |
| Polymer content (%) | 4.8 | 4.1 | 3.8 | 2.1 | 2.2 | 2.7 | 2.6 |
| Viscosity index | 221 | 205 | 195 | 166 | 163 | 162 | 158 |
| Pour point (° C.) | −40 | −35 | −40 | −15 | −15 | −15 | −15 |
| SSI | 42 | 30 | 30 | 18 | 19 | 17 | 26 |

EXAMPLES 41 AND 42

The polymer solutions obtained in Examples 5 and 36 were diluted with 100 neutral oil so that they may have a polymer concentration of 3%, and the resulting solutions were subjected to the test stipulated in JIS K-2514 for 72 hours to measure the sludge amounts, respectively, to find that the sludge amounts in the solutions were 0.2% and 0.3% respectively.

Comparative Examples 8 and 9

The polymer solution obtained in Comparative Example 1 and SDC1 were diluted with 100 neutral oil so that they may have a polymer concentration of 3% respectively. The resulting solutions were subjected to sludge quantitative determination as described in Example 41, to find that the sludge amounts in the solutions were 4.5% and 5.2% respectively.

As is clear from the results shown in Tables 1 to 8, the viscosity index improvers of Examples 1 to 40 are excellent in stability in solutions, viscosity index improving property, thickening effect, low-temperature fluidity and shear stability. In addition, the viscosity improver of Example 1 showed a great thickening effect and excellent shear stability compared with that of Comparative Example 1 containing only polymethacrylates of the same composition as in Example 1.

Further, as shown in Table 9, the viscosity index improvers of Examples have excellent stability in solutions and excellent thickening effects compared with those of Comparative Examples 2 and 3 which are prepared by carrying out grafting of polymer mixtures using the ordinary radical polymerization initiators respectively. This is because that the viscosity index improvers of Examples contain large amounts of graft copolymers compared with those prepared by the conventional methods.

Further, the viscosity index improvers of Examples each have excellent viscosity index and low-temperature fluidity compared with those of Comparative Examples 4 to 7 which contain only oil-soluble polymers.

In addition, it can be understood that the viscosity index improvers of Examples 41 and 42 can be easily imparted with detergent dispersing performance.

It should be noted here that the present invention is not to be limited to Examples given above but may be modified arbitrarily without departing from the gist of the invention.

INDUSTRIAL APPLICABILITY

As has been described heretofore, the viscosity index improvers according to the present invention have excellent viscosity index improving properties, thickening effects, low-temperature fluidity and shear stability, and high-performance lubricating oils can be obtained by adding them in small amounts to lubricating oils such as engine oils and gear oils, so that they can be utilized suitably as lubricating oil additives.

What is claimed is:

1. A viscosity index improver comprising a graft copolymer having a molecular weight in the range of between about 10,000 to 2,000,000 as the weight average; said graft copolymer having a structural unit formed by an oil-soluble polymer (a) containing an olefin polymer and a structural unit formed by a peroxy bond-containing polymer (b) obtained from a monomer represented by the formulas (1), (2) or (3) as follows:

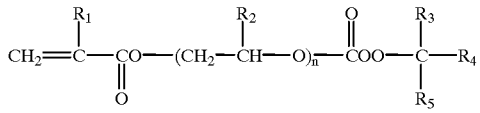

(1)

wherein $R_1$ represents a hydrogen atom or a methyl group; $R_2$ represents a hydrogen atom or a methyl group; $R_3$ and $R_4$ each represent an alkyl group having 1 to 4 carbon atoms; $R_5$ represents an alkyl group having 1 to 12 carbon atoms, a cycloalkyl group having 3 to 12 carbon atoms, a phenyl group or an alkyl-substituted phenyl group; and n is 1 to 5;

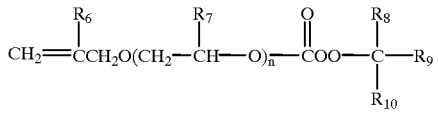

(2)

wherein $R_6$ represents a hydrogen atom or a methyl group; $R_7$ represents a hydrogen atom or a methyl group; $R_8$ and $R_9$ each represent an alkyl group having 1 to 4 carbon atoms; $R_{10}$ represents an alkyl group having 1 to 12 carbon atoms, a cycloalkyl group having 3 to 12 carbon atoms, a phenyl group or an alkyl-substituted phenyl group; and n is 0 to 4;

(3)

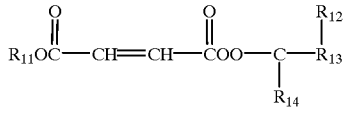

wherein $R_{11}$ represents a hydrogen atom or a methyl group; $R_{12}$ and $R_{13}$ each represent an alkyl group having 1 to 4 carbon atoms; $R_{14}$ represents an alkyl group having 1 to 12 carbon atoms, a cycloalkyl group having 3 to 12 carbon atoms, a phenyl group or an alkyl-substituted phenyl group; or a polymer (c) obtained by copolymerizing the peroxy bond-containing copolymer (b) with a monomer being selected from the group consisting of the tertiary nitrogen-containing monomers and monomers containing either or both of a hydroxyl group and an ether bond, said tertiary nitrogen-containing monomers being selected from the group consisting of vinylpyrrolidone, vinylpyridine, vinylimidazol, dimethylaminoethyl(meth)acrylate, dimethylaminopropyl(meth)acrylate, dimethylaminoethyl (meth)acrylamide, dimethyl(meth)acrylamide and (meth) acrylonitrile, said hydroxyl or ether bond containing monomers are alkyl(meth)acrylates of the formula:

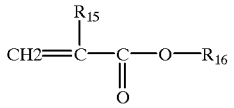

wherein $R_{15}$ is a hydrogen atom or a methyl group, $R_{16}$ is a $C_1$–$C_6$ alkyl group having at least one hydroxyl group or a group of the following formula:

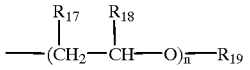

wherein $R_{17}$ and $R_{18}$ each represent a hydrogen atom or a methyl group, $R_{19}$ is a hydrogen atom or a $C_1$–$C_3$ alkyl group, and n is an integer of 1 to 60; the weight ratio of the oil-soluble polymer (a) to the peroxy bond containing polymer (b) or (c) being in the range of 5 to 95 to 95 to 5.

2. The viscosity index improver according to claim 1, wherein the oil-soluble polymer (a), the polymers (b) and (c) are as follows:

(a) one or more oil-soluble polymers selected from the group consisting of ethylene/α-olefin copolymers, styrene/hydrogenated diene copolymers, hydrogenated polybutadienes, hydrogenated polyisoprenes, polybutenes, ethylene/(meth)acrylic acid ester copolymers and ethylene/vinyl ester copolymers;

(b) a copolymer to be obtained by copolymerizing a peroxy bond-containing monomer with one or more monomers selected from the group consisting of (meth) acrylic acid esters, unsaturated dicarboxylic acid esters, vinyl esters of fatty acids having 2 to 18 carbon atoms and aromatic monomers having 8 to 12 carbon atoms; and (c) a copolymer to be obtained by copolymerizing a peroxy bond-containing monomer with one or more monomers selected from the group consisting of (meth) acrylic acid esters, unsaturated dicarboxylic acid esters, vinyl esters of fatty acids having 2 to 18 carbon atoms and aromatic monomers having 8 to 12 carbon atoms and with one or more monomers selected from the group consisting of tertiary nitrogen-containing monomers and monomers containing either or both of a hydroxyl group and an ether bond, said tertiary nitrogen-containing monomers being selected from the group consisting of vinylpyrrolidone, vinylpyridine, vinylimidazol, dimethylaminoethyl(meth)acrylate, dimethylaminopropyl(meth)acrylate, dimethylaminoethyl(meth)acrylamide, dimethyl(meth) acrylamide and (meth)acrylonitrile, said hydroxyl or ether bond containing monomers are alkyl(meth) acrylates of the formula:

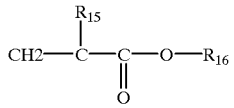

wherein $R_{15}$ is a hydrogen atom or a methyl group, $R_{16}$ is a $C_1$–$C_6$ alkyl group having at least one hydroxyl group or a group of the following formula:

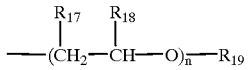

wherein $R_{17}$ and $R_{18}$ each represent a hydrogen atom or a methyl group, $R_{19}$ is a hydrogen atom or a $C_1$–$C_3$ alkyl group, and n is an integer of 1 to 60.

3. The viscosity index improver according to claim 2, wherein the content of one or more monomers selected from the group consisting of tertiary nitrogen-containing monomers and monomers containing either or both of a hydroxyl group and an ether bond in the polymer (c) is set to be not more than 20% by weight.

4. The viscosity index improver according to claim 2, wherein the oil-soluble polymer (a), the polymers (b) and (c) are as follows:

(a) an oil-soluble polymer which is an ethylene/α-olefin copolymer or styrene/hydrogenated diene;

(b) a copolymer to be obtained by copolymerizing a peroxy bond-containing monomer with (meth)acrylic acid esters; and (c) a copolymer to be obtained by copolymerizing a peroxy bond-containing monomer with (meth)acrylic acid ester and with one or more monomers selected from the group consisting of tertiary nitrogen-containing monomers and monomers containing either or both of a hydroxyl group and an ether bond, said tertiary nitrogen-containing monomers being selected from the group consisting of vinylpyrrolidone, vinylpyridine, vinylimidazol, dimethylaminoethyl (meth)acrylate, dimethylaminopropyl(meth)acrylate, dimethylaminoethyl(meth)acrylamide, dimethyl(meth) acrylamide and (meth)acrylonitrile, said hydroxyl or ether bond containing monomers are alkyl(meth) acrylates of the formula:

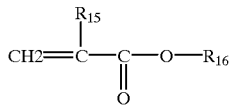

wherein $R_{15}$ is a hydrogen atom or a methyl group, $R_{16}$ is a $C_1$–$C_6$ alkyl group having at least one hydroxyl group or a group of the following formula:

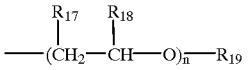

wherein $R_{17}$ and $R_{18}$ each represent a hydrogen atom or a methyl group, $R_{19}$ is a hydrogen atom or a $C_1$–$C_3$ alkyl group, and n is an integer of 1 to 60.

5. The viscosity index improver according to claim 2, wherein the oil-soluble polymer (a) is an ethylene/propylene copolymer, a styrene/hydrogenated diene block copolymer or a styrene/hydrogenated diene/styrene triblock copolymer.

6. The viscosity index improver according to claim 1, wherein the oil-soluble polymer (a), the polymers (b) and (c) are as follows:

(a) one or more oil-soluble polymers selected from the group consisting of ethylene/α-olefin copolymers, styrene/hydrogenated butadiene or hydrogenated isoprene copolymer, hydrogenated polybutadienes, hydrogenated polyisoprenes and polybutenes;

(b) a copolymer to be obtained by copolymerizing a peroxy bond-containing monomer with (meth)acrylic acid esters; and (c) a copolymer to be obtained by copolymerizing a peroxy bond-containing monomer with meth (acrylic) acid esters and with one or more monomers selected from the group consisting of tertiary nitrogen-containing monomers and monomers containing either or both of a hydroxyl group and an ether bond, unsaturated dicarboxylic acid esters, vinyl esters of fatty acids having 1 to 5 carbon atoms and aromatic monomers having 8 to 10 carbon atoms; said tertiary nitrogen-containing monomers being selected from the group consisting of vinylpyrrolidone, vinylpyridine, vinylimidazol, dimethylaminoethyl(meth)acrylate, dimethylaminopropyl(meth)acrylate, dimethylaminoethyl(meth)acrylamide, dimethyl(meth) acrylamide and (meth)acrylonitrile, said hydroxyl or ether bond containing monomers are alkyl(meth) acrylates of the formula:

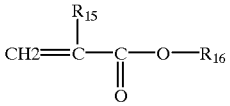

wherein $R_{15}$ is a hydrogen atom or a methyl group, $R_{16}$ is a $C_1$–$C_6$ alkyl group having at least one hydroxyl group or a group of the following formula:

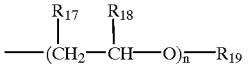

wherein $R_{17}$ and $R_{18}$ each represent a hydrogen atom or a methyl group, $R_{19}$ is a hydrogen atom or a $C_1$–$C_3$ alkyl group, and n is an integer of 1 to 60.

7. The viscosity index improver according to claim 6, wherein the oil-soluble polymer (a) is an ethylene/propylene copolymer, a styrene/hydrogenated diene diblock copolymer or a styrene/hydrogenated diene/styrene triblock copolymer.

8. A process for producing a viscosity index improver as set forth in claim 1, which comprises heating a mixture of the following oil-soluble polymer (a) and the following peroxy bond-containing copolymer (b) or (c) to such a temperature that peroxy bonds cleave to effect grafting:

(a) one or more oil-soluble polymers selected from the group consisting of ethylene/α-olefin copolymers, styrene/hydrogenated diene copolymers, hydrogenated polybutadienes, hydrogenated polyisoprenes, polybutenes, ethylene/(meth)acrylic acid ester copolymers and ethylene/vinyl ester copolymers; and (b) a copolymer to be obtained by copolymerizing a peroxy bond-containing monomer with one or more monomers selected from the group consisting of (meth) acrylic acid esters, unsaturated dicarboxylic acid esters, vinyl esters of fatty acids having 2 to 18 carbon atoms and aromatic monomers having 8 to 12 carbon atoms; or (c) a copolymer to be obtained by copolymerizing a peroxy bond-containing monomer with one or more monomers selected from the group consisting of (meth) acrylic acid esters, unsaturated dicarboxylic acid esters, vinyl esters of fatty acids having 2 to 18 carbon atoms and aromatic monomers having 8 to 12 carbon atoms and with one or more monomers selected from the group consisting of tertiary nitrogen-containing monomers and monomers containing either or both of a hydroxyl group and an ether bond, said tertiary nitrogen-containing monomers being selected from the group consisting of vinylpyrrolidone, vinylpyridine, vinylimidazol, dimethylaminoethyl(meth)acrylate, dimethylaminopropyl(meth)acrylate, dimethylaminoethyl(meth)acrylamide, dimethyl(meth) acrylamide and (meth)acrylonitrile, said hydroxyl or ether bond containing monomers are alkyl(meth) acrylates of the formula:

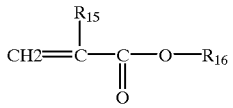

wherein $R_{15}$ is a hydrogen atom or a methyl group, $R_{16}$ is a $C_1$–$C_6$ alkyl group having at least one hydroxyl group or a group of the following formula:

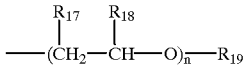

wherein $R_{17}$ and $R_{18}$ each represent a hydrogen atom or a methyl group, $R_{19}$ is a hydrogen atom or a $C_1$–$C_3$ alkyl group, and n is an integer of 1 to 60.

9. A process for producing a viscosity index improver as set forth in claim 1, which comprises adding to a lubricant base oil the following monomer mixture (d) or (e) and a radical polymerization initiator to effect copolymerization of the monomer mixture at such a temperature that the radical polymerization initiator decomposes and that peroxy bonds of the peroxy bond-containing monomer do not substantially cleave, and adding the following oil-soluble polymer (a) to the resulting mixture to be dissolved therein, followed by heating of the mixture to such a temperature that peroxy bonds derived from the peroxy bond-containing monomer cleave to effect grafting:

(a) one or more oil-soluble polymers selected from the group consisting of ethylene/α-olefin copolymers, hydrogenated styrene/diene copolymers, hydrogenated polybutadienes, hydrogenated polyisoprenes, polybutenes, ethylene/(meth)acrylic acid ester copolymers and ethylene/vinyl ester copolymers;

(d) a monomer mixture containing a peroxy bond-containing monomer and one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms; and (e) a monomer mixture containing a peroxy bond-containing monomer, one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms and one or more monomers selected from the group consisting of tertiary nitrogen-containing monomers and monomers containing either or both of a hydroxyl group and an ether bond, said tertiary nitrogen-containing monomers being selected from the group consisting of vinylpyrrolidone, vinylpyridine, vinylimidazol, dimethylaminoethyl(meth)acrylate, dimethylaminopropyl(meth)acrylate, dimethylaminoethyl(meth)acrylamide, dimethyl(meth) acrylamide and (meth)acrylonitrile, said hydroxyl or ether bond containing monomers are alkyl(meth) acrylates of the formula:

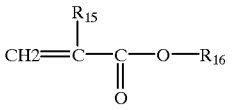

wherein $R_{15}$ is a hydrogen atom or a methyl group, $R_{16}$ is a $C_1$–$C_6$ alkyl group having at least one hydroxyl group or a group of the following formula:

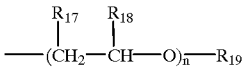

wherein $R_{17}$ and $R_{18}$ each represent a hydrogen atom or a methyl group, $R_{19}$ is a hydrogen atom or a $C_1$–$C_3$ alkyl group, and n is an integer of 1 to 60.

10. The process for producing a viscosity index improver as set forth in claim 1, which comprises adding to a lubricant base oil the following oil-soluble polymer (a), the following monomer mixture (d) or (e) and a radical polymerization initiator to effect copolymerization of the monomer mixture at such a temperature that the radical polymerization initiator decomposes and that peroxy bonds of the peroxy bond-containing monomer do not substantially cleave, followed by heating of the resulting mixture to such a temperature that peroxy bonds derived from the peroxy bond-containing monomer cleave to effect grafting:

(a) one or more oil-soluble polymers selected from the group consisting of ethylene/α-olefin copolymers, styrene/hydrogenated diene copolymers, hydrogenated polybutadienes, hydrogenated polyisoprenes, polybutenes, ethylene/(meth)acrylic acid ester copolymers and ethylene/vinyl ester copolymers; and (d) a monomer mixture containing a peroxy bond-containing monomer and one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms; and (e) a monomer mixture containing a peroxy bond-containing monomer, one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms and one or more monomers selected from the group consisting of tertiary nitrogen-containing monomers and monomers containing either or both of a hydroxyl group and an ether bond, said tertiary nitrogen-containing monomers being selected from the group consisting of vinylpyrrolidone, vinylpyridine, vinylimidazol, dimethylaminoethyl(meth)acrylate, dimethylaminopropyl(meth)acrylate, dimethylaminoethyl(meth)acrylamide, dimethyl(meth) acrylamide and (meth)acrylonitrile, said hydroxyl or ether bond containing monomers are alkyl(meth) acrylates of the formula:

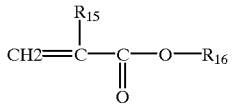

wherein $R_{15}$ is a hydrogen atom or a methyl group, $R_{16}$ is a $C_1$–$C_6$ alkyl group having at least one hydroxyl group or a group of the following formula:

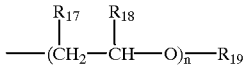

wherein $R_{17}$ and $R_{18}$ each represent a hydrogen atom or a methyl group, $R_{19}$ is a hydrogen atom or a $C_1$–$C_3$ alkyl group, and n is an integer of 1 to 60.

11. A process for producing a viscosity index improver as set forth in claim 1, which comprises a first step of adding to an aqueous suspension of particles of the following oil-soluble polymer (a) the following monomer mixture (d) or (e) and a radical polymerization initiator, and heating the resulting mixture at such a temperature that the radical polymerization initiator does not substantially decompose to impregnate the particulate oil-soluble polymer (a) with the monomer mixture and the radical polymerization initiator, followed by heating of the resulting aqueous suspension at such a temperature that the radical polymerization initiator decomposes and that the peroxy bonds of the peroxy bond-containing monomer do not substantially cleave to effect copolymerization of the monomer mixture in the particulate oil-soluble polymer (a) and obtain a graft precursor; and a second step of melt-kneading the graft precursor at such a temperature that peroxy bonds derived from the peroxy bond-containing monomer cleave to effect grafting:

(a) one or more oil-soluble polymers selected from the group consisting of ethylene/α-olefin copolymers, styrene/hydrogenated diene copolymers, hydrogenated polybutadienes, hydrogenated polyisoprenes, polybutenes, ethylene/(meth)acrylic acid ester copolymers and ethylene/vinyl ester copolymers; and (d) a monomer mixture containing a peroxy bond-containing monomer and one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms; or (e) a monomer mixture containing a peroxy bond-containing monomer, one or more monomers selected from the group consisting of (meth)acrylic acid esters, unsaturated discarboxylic acid esters, vinyl esters of fatty acids having 2 to 18 carbon atoms and aromatic monomers having 8 to 12 carbon atoms and one or more monomers selected from the group consisting of tertiary nitrogen-containing monomers and monomers containing either or both of a hydroxyl group and an ether bond, said tertiary nitrogen-containing monomers being selected from the group consisting of vinylpyrrolidone, vinylpyridine, vinylimidazol, dimethylaminoethyl(meth)acrylate, dimethylaminopropyl(meth)acrylate, dimethylaminoethyl(meth)acrylamide, dimethyl(meth) acrylamide and (meth)acrylonitrile, said hydroxyl or ether bond containing monomers are alkyl(meth) acrylates of the formula:

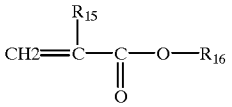

wherein $R_{15}$ is a hydrogen atom or a methyl group, $R_{16}$ is a $C_1$–$C_6$ alkyl group having at least one hydroxyl group or a group of the following formula:

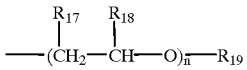

wherein $R_{17}$ and $R_{18}$ each represent a hydrogen atom or a methyl group, $R_{19}$ is a hydrogen atom or a $C_1$–$C_3$ alkyl group, and n is an integer of 1 to 60.

12. A lubricating oil composition comprising a lubricating oil containing the viscosity index improver according to claim 1.

13. A viscosity index improver comprising a graft copolymer (i), polymer (ii) or copolymer (iii), or polymer (ii) and coploymer (iii):

graft copolymer (i) is obtained by grafting one or more oil-soluble polymers selected from the group consisting of ethylene/α-olefin copolymers, styrene/hydrogenated diene copolymers, hydrogenated polybutadienes, hydrogenated polyisoprenes, polybutenes, ethylene/(meth)acrylic acid ester copolymers and ethylene/vinyl ester copolymers to or with peroxy bond-containing copolymers (b) to be obtained by copolymerizing a peroxy bond-containing monomer with one or more monomers selected from the group consisting of (meth) acrylic acid esters, unsaturated dicarboxylic acid esters, vinyl esters of fatty acids having 2 to 18 carbon atoms and aromatic monomers having 8 to 12 carbon atoms; or a copolymer (c) to be obtained by copolymerizing a peroxy bond-containing monomer with one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms and with one or more monomers selected from the group consisting of tertiary nitrogen-containing monomers and monomers containing either or both of a hydroxyl group and an ether bond;

graft polymer (ii) is one or more oil-soluble polymers selected from the group consisting of ethylene/α-olefin copolymers, styrene/hydrogenated diene copolymers, hydrogenated polybutadienes, hydrogenated polyisoprenes, polybutenes, ethylene/(meth)acrylic acid ester copolymers and ethylene/vinyl ester copolymers;

graft copolymer (iii) is a copolymer derived from a copolymer to be obtained by copolymerizing a peroxy bond-containing monomer with one or more monomers selected from the group consisting of (meth)acrylic acid esters, unsaturated dicarboxylic acid esters, vinyl esters of fatty acids having 2 to 18 carbon atoms and aromatic monomers having 8 to 12 carbon atoms; or a copolymer (c) to be obtained by copolymerizing a peroxy bond-containing monomer with one or more monomers selected from the group consisting of (meth) acrylic acid esters, unsaturated dicarboxylic acid esters, vinyl esters of fatty acids having 2 to 18 carbon atoms and aromatic monomers having 8 to 12 carbon atoms and with one or more monomers selected from the group consisting of tertiary nitrogen-containing monomers and monomers containing either or both of a hydroxyl group and an ether bond, said tertiary nitrogen-containing monomers being selected from the group consisting of vinylpyrrolidone, vinylpyridine, vinylimidazol, dimethylaminoethyl(meth)acrylate, dimethylaminopropyl(meth)acrylate, dimethylaminoethyl(meth)acrylamide, dimethyl(meth) acrylamide and (meth)acrylonitrile, said hydroxyl or ether bond containing monomers are alkyl(meth) acrylates of the formula:

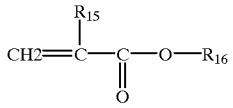

wherein $R_{15}$ is a hydrogen atom or a methyl group, $R_{16}$ is a $C_1$–$C_6$ alkyl group having at least one hydroxyl group or a group of the following formula:

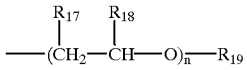

wherein $R_{17}$ and $R_{18}$ each represent a hydrogen atom or a methyl group, $R_{19}$ is a hydrogen atom or a $C_1$–$C_3$ alkyl group, and n is an integer of 1 to 60.

14. The viscosity index improver according to claim 13, wherein the content of one or more monomers selected from the group consisting of tertiary nitrogen-containing monomers and monomers containing either or both of a hydroxyl group and an ether bond in the polymer (c) is set to be not more than 20% by weight.

15. A lubricating oil composition comprising a lubricating oil containing the viscosity index improver according to claim 14.

16. The viscosity index improver according to claim 13, wherein the oil-soluble polymer (a) is an ethylene/propylene copolymer, a styrene/hydrogenated diene diblock copolymer or a styrene/hydrogenated diene/styrene triblock copolymer.

* * * * *